United States Patent [19]

Sanders

[11] Patent Number: 5,025,564

[45] Date of Patent: Jun. 25, 1991

[54] SIGHT VIEWING APPARATUS

[76] Inventor: Ronald J. Sanders, P.O. Box 658, Floodwood, Minn. 55736

[21] Appl. No.: 352,551

[22] Filed: May 16, 1989

Related U.S. Application Data

[60] Continuation-in-part of Ser. No. 176,617, Apr. 1, 1988, Pat. No. 4,920,654, which is a division of Ser. No. 917,799, Oct. 9, 1986, Pat. No. 4,734,989, which is a continuation-in-part of Ser. No. 855,959, Apr. 25, 1986, Pat. No. 4,734,990.

[51] Int. Cl.[5] ..... F41G 1/32

[52] U.S. Cl. ..... 33/241; 33/297

[58] Field of Search ..... 33/244, 241, 242, 243, 33/246, 258, 277-281, 297, 298, 233; 356/251, 247

[56] References Cited

U.S. PATENT DOCUMENTS

| | | | |
|---|---|---|---|
| 1,302,353 | 4/1919 | Friedrich | 33/241 |
| 2,399,431 | 4/1946 | Gazda | 33/261 |
| 2,430,469 | 11/1947 | Karnes | 33/241 |
| 2,553,540 | 5/1951 | Beckerman | 33/243 |
| 2,559,927 | 7/1951 | Beloungy | 33/265 |
| 3,284,904 | 11/1966 | Rade | 33/265 |
| 4,481,717 | 11/1984 | Kowalski | 33/265 |

*Primary Examiner*—Harry N. Haroian

*Attorney, Agent, or Firm*—Peterson, Wicks, Nemer & Kamrath

[57] ABSTRACT

A viewing and sighting apparatus is disclosed in its preferred form utilizing a self-luminous lighting material marked on and within clear see-through lenses and may be provided with an electronically lit light source. The sighting device is characterized by a see-through tubular structure with a front clear lens having a cross-like image marked through its center and a rear clear lens having a circle-like image marked in its center. This sighting device is affixed with a means of adjusting the position of the rear circle image in its relationship to the center of the front cross and a means to mount on various weapons of use. The viewing and sighting apparatus may be used to isolate a target area and aim and direct projectile impace to a specific target within the isolated target area and may be further used in darkened conditions.

20 Claims, 3 Drawing Sheets

SIGHT VIEWING APPARATUS

CROSS REFERENCE

The present application is a continuation-in-part of application Ser. No. 17/176,617 filed Apr. 1, 1988, now U.S. Pat. No. 4,920,654, which in turn is a divisional application of application Ser. No. 917,799 filed Oct. 9, 1986, now U.S. Pat. No. 4,734,989, which in turn is a continuation-in-part application of application Ser. No. 855,959 filed Apr. 25, 1986, now U.S. Pat. No. 4,734,990.

BACKGROUND

There are presently various optical sight alignment means available for use on firearms and non-firearms such as crossbows, bows, etc. Primarily, most optical lens sights are used on high power firearms because of the magnification extreme, which is not necessarily required on short range, less powerful and less accurate weaponry and because of the trajectory limitations of less powerful weapons. Those optical sights which have no magnification or low magnification are for the most part too expensive for novice use and therefore most novice users of lower power weapons go afield with less than adequate sighting means, which, of course, increases the amount of wounded game animals.

This invention then relates to the making of a high quality, inexpensive optical sight which can be used effectively in all light conditions and can be adapted to most firearms and non-firearms which need extended eye relief mounting and no or low magnification to function effectively in the field.

Although the features of this invention, which are believed to be novel, are set forth in the claims, details as to its organization and method of operation, together with the further objects and advantages thereof, may be best understood through reference to the following description taken in connection with the accompanying drawings.

DESCRIPTION OF THE DRAWINGS

The illustrative embodiments may best be described by reference to the accompanying drawings where:

FIG. 4 shows an exploded side view of a sight lens insert of the sight viewing apparatus of FIG. 1.

FIG. 5 shows an exploded perspective view of an alternate embodiment of a sight lens insert for use in the sight viewing apparatus of FIG. 1.

Figure 1:
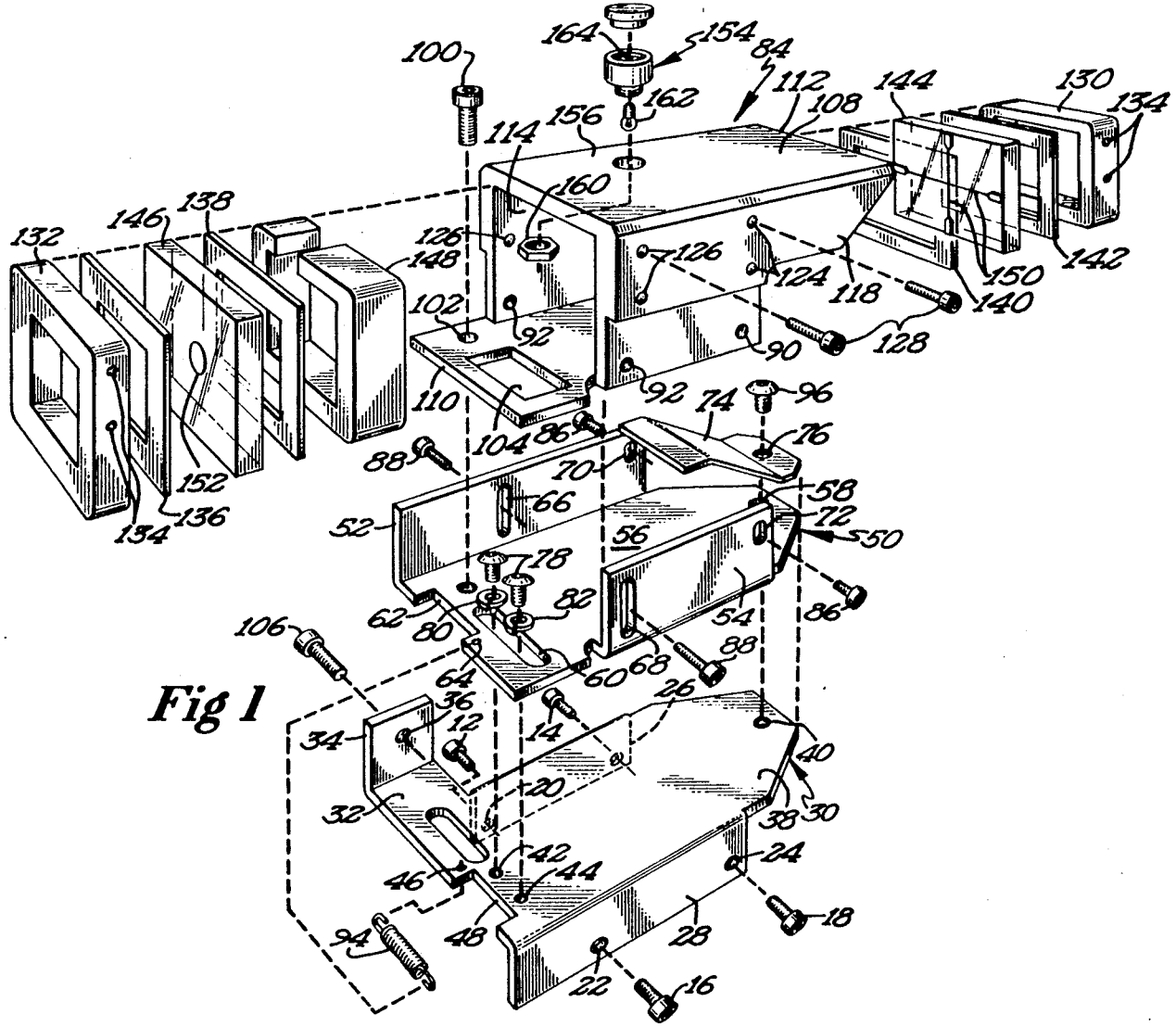
FIG. 1 shows an exploded perspective view of a preferred form of a sight viewing apparatus according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "front", "rear", "windage", "elevation", and similar terms are used herein, it should be understood that these terms have reference only to the structure shown in the drawings as it would appear to a person viewing the drawings and are utilized only to facilitate describing the invention.

DESCRIPTION

A sight viewing apparatus according to the preferred teachings of the present invention is shown in the drawings. Specifically, the apparatus shown is an extended eye relief viewing and sighting apparatus for use with firearms and with non-firearms. In the preferred form, the apparatus isolates a specific target area from its immediate surroundings. In the most preferred form, the apparatus is used to aim and direct projectile impact and particularly to isolate a target area and aim and direct projectile impact to a specific target within the isolated target area.

Particularly, the sighting device shown is attached to the weapon or firearm by four threaded screws 12, 14, 16 and 18 which pass through clearance holes 20, 22 and 24 of sight mounting arms 26 and 28 of swivel base 30. Swivel base 30 is affixed with an extended side arm 32 with an upwards angled extension 34 that has a threaded adjustment key hole 36 located in its center. Swivel base 30 also has in the front center of its flat platform base 38 a centrally located threaded swivel pin hole 40 and adjusting locking holes 42 and 44 located in the rear of platform base 38. Also in the rear of platform base 38 is an extension spring connection hole 46 and a spring bed slot 48. Swivel base 30 is connected to housing carriage 50 by an extension spring 94 and a threaded swivel pin 96. Housing carriage 50 has upward extending arms 52 and 54 on each side of housing carriage flat surface 56, with extending arm 52 being larger than extending arm 54. The housing carriage flat surface 56 has a clearance hole 58 centrally located in the front through which the threaded swivel pin 96 passes and is screwed to swivel base 30 through threaded swivel pin hole 40 to define a windage pivot axis which is perpendicular to the sighting line of the sighting device. In the rear of the housing carriage flat surface 56 of housing carriage 50 is a clearance slot 60 and an extension spring recession 62 and connection hole 64. Elevation lock slots 66 and 68 are located in the rear of upward extending arms 52 and 54 and pivot clearance holes 70 and 72 are located in the front of upward extending arms 52 and 54. Before housing carriage 50 is connected to swivel base 30 by threaded swivel pin 96, an elevation spring 74 that has a clearance hole 76 centered in its front is also held in place by threaded swivel pin 96 and sets in flat surface 56 of housing carriage 50. Elevation spring 74 is a flat spring shaped and configured to extend upwards and operates in a compression manner. Threaded windage locking screw 78 and star lock washers 80 and 82 screw to swivel base 30 through clearance slot 60 and into adjusting locking holes 42 and 44. Sight housing 84 is secured to housing carriage 50 by threaded screw 86 which passes through pivot clearance holes 70 and 72 in extending arms 52 and 54 and screw into sight housing 84 in the forward threaded hole 90 located on the forward lower corner of sight housing 84 to define an elevation axis which is perpendicular to the windage axis and to the sighting line of the sighting device. Sight housing 84 also has rear threaded holes 92 that accept threaded screws 88 that are passed through clearance elevation lock slots 66 and 68 in housing carriage 50. The upward pressure from elevation spring 74 in the rear biases sight housing 84 in a second direction about screws 86 in a second direction and keeps the rear of sight housing 84 in an upward position until compressed by elevation adjustment screw 100 which passes through a clearance hole 102 of sight housing 84 to push sight housing 84 in a direction opposite to the second, biasing direction of spring 74 for adjusting the elevation of housing 84. Also in the rear of sight housing 84 is a slot 104 which allows access to tighten windage locking screws 76 and 78. Windage adjustment screw 106 threads through upward angled extension 34 of swivel base 30 and pushes against the wall of extending arm 52 of housing carriage 50. The extension spring 94 that connects to connection hole 64 in the housing carriage 50 and extension spring connection hole 46 in swivel base 30 biases the housing carriage 50 to pivot about pin 96 in a first direction and extends and contracts according to the pressure applied by windage adjustment screw 106 on the wall of extending arm 52 which adjustably pushes housing carriage 50 in a direction opposite to the first direction. The sight housing 84 has a front opening 112 and a rear opening 114 and a rear platform 110 containing slot 104. The front opening 112 is hooded by hood extension 108 with shading arms 116 and 118. The sight housing 84 has four sets of clearance holes, front clearance holes 124 and rear clearance holes 126, with two sets being on each side of sight housing 84.

Figure 2:
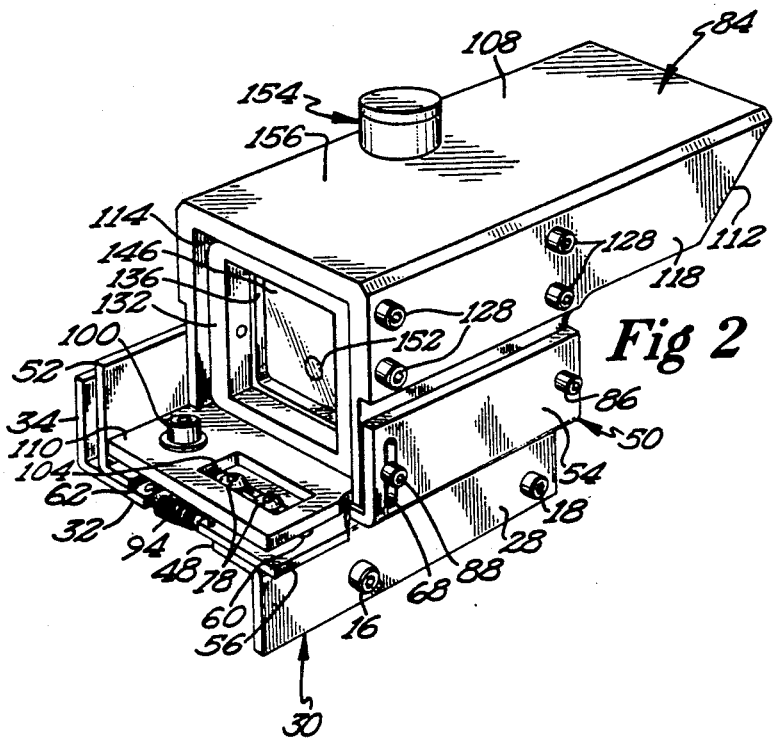
FIG. 2 shows a perspective view of the sight viewing apparatus of FIG. 1.
Figure 3:
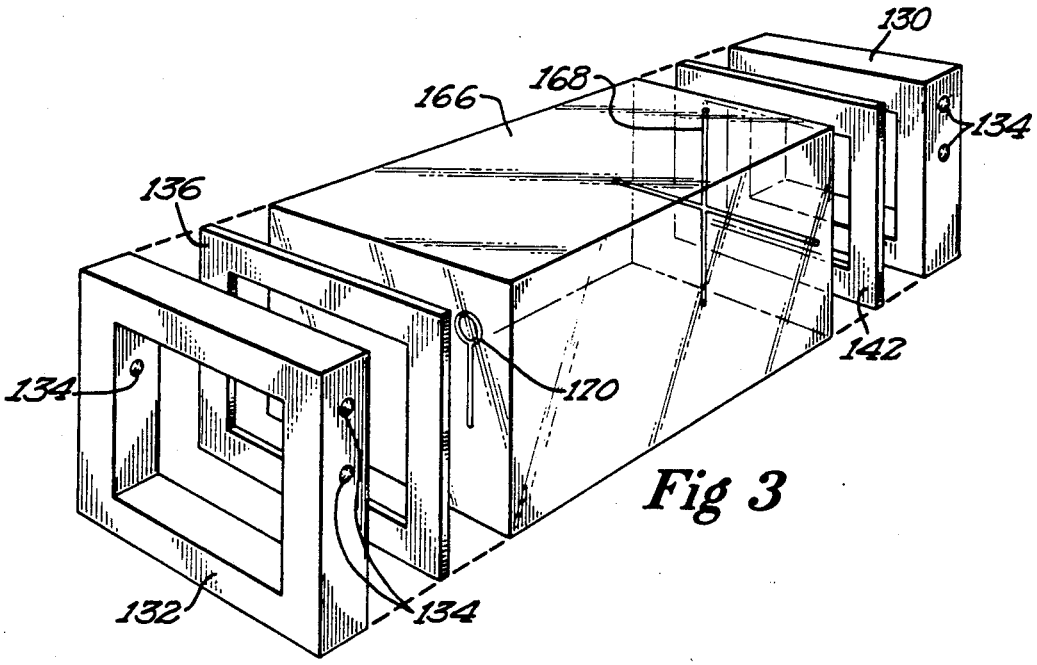
FIG. 3 shows a side cross sectional view of the sight viewing apparatus of FIG. 1.

Whereas FIGS. 1 and 2 show the entire sight and sight assembly, FIGS. 3 and 4 show the inner lens assembly of the sight apparatus as it relates to securing the lenses in a spaced apart relation and adjacent the front and rear openings of the housing and the positioning of the sight lens electronic lighting means. Secured to the inner wall of sight housing 84 in FIG. 3 by eight threaded screws 128 received in mating threaded holes 134, two on each side, are lens holders 130 and 132 which generally abut with lenses 144 and 146, respectively. Rubber washers 136, 138, 140 and 142 compress on both sides of front and rear sight lenses 144 and 146. In the most preferred form, the openings of rubber washers 136 and 138 which effectively define the rear opening of housing 84 is smaller than the opening of rubber washers 140 and 142 which effectively define the front opening of housing 84. Thus, when viewing through lens 144 and 146 the device isolates a specific target area from its immediate surroundings. Similarly, lens 146 can be made effectively smaller by silk screening a border adjacent its periphery while marking 152 is being silk screened. The innermost rubber washers 138 and 140 are held apart by lens spacer 148 received in housing 84 intermediate the front and rear openings. Sight lenses 144 and 146 of FIGS. 1 and 3 have silk screened or etched designs marked on the their surfaces. Lens 144 has a cross-like marking 150 and lens 146 has a circular marking 152 which is positioned according to the apex of the cross-like marking 150 of lens 144 so that when sighted properly on a target on a level plane along a sighting line, the circular marking 152 of lens 146 would appear centered on the cross-like marking 150 of lens 144 when viewed through. The cross-like marking 150 and the circular marking 152 are both coated with a non-transparent, irridescent matter causing daylight exposure to activate the irridescent matter to self-luminate under low light conditions such as at dusk or predawn hours without the use of artificial illumination. However, to enhance the light collecting properties of the irridescent matter when daylight is not available, a miniature battery-operated light source 154 is adapted through the top flat surface 156 of sight housing 84 and is secured from the inner wall by a fastening nut 160. This method of adapting a light and light power source allows for only the tiny light element 162 to be internal while the power source 164 for the light element 162 is external where it can be easily turned on or off.

Whereas FIGS. 1–4 show one method of the inner assembly of the sight as it relates to the spacing of the lenses, FIG. 5 shows a second manner of assembling the internal components in FIGS. 1, 2, 3 and 4, in which the irridescent cross-like marking 150 and circular marking 152 in FIGS. 1 and 3 are replaced in a solid block of clear material 166 by two chambers filled with non-transparent liquid, one a cross-like marking 168 and the other a circular marking 170. In the most preferred form, the liquid is self-luminous, and preferably does not require exposure to sun light or artificial light to luminate such as tritium. In this configuration the rubber washers 138 and 140, along with the lens spacer 148, are eliminated and replaced by the solid block of clear material 166 which is integral with and intermediate lens 144 and 146. Because the liquid material is also of a self-luminous nature under low light conditions that does not require daylight or artificial light to luminate, this configuration would also eliminate the need for an artificial light and light power source.

It is obvious that a new sighting apparatus for use on firearms and non-firearms is hereby created and can be a valuable accessory used by sportsmen and shooters, a sighting apparatus that is low cost to manufacture and can be mass produced and sold to the consumer at a fraction of the cost of comparable optical sights. This sighting device can be formed, shaped and otherwise configured to be used on or in conjunction with other practical equipment such as surveying equipment, laser cutting equipment, etc.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Sighting device comprising, in combination: a front lens; a rear lens; means for securing the front lens and the rear lens in a spaced apart relation; a housing having a front opening and a rear opening, with the front lens positioned adjacent the front opening of the housing and with the rear lens positioned adjacent the rear opening of the housing; with the securing means comprising, in combination: a lens spacer for receipt in the housing intermediate the front and rear openings, with the front lens located within the housing and abutting with the lens spacer, with the front lens and the rear lens located on opposite sides of the lens spacer; and a first lens holder held in the housing adjacent the front opening for abutting with the front lens opposite to the lens spacer; a first design marked on the front lens; and a second design marked on the rear lens, with the first design appearing to be centered on the second design when viewing along a sighting line through the front lens and the rear lens on a level plane.

2. The sighting device of claim 1 wherein the first design is a cross-like marking, and wherein the second design is a circular marking, with the cross-like marking appearing to be centered on the circular marking when viewing through the front lens and the rear lens on a level plane.

3. The sighting device of claim 2 wherein the first and second designs are silk-screened on the surfaces of the front and rear lenses.

4. The sighting device of claim 3 wherein the first and second designs are formed of irridescent matter which self-luminates during low light conditions after exposure to light.

5. The sighting device of claim 1 further comprising, in combination: a miniature light source located internally of the housing for exposing the first and second designs to light, with the housing being substantially closed aside from the front opening and the rear opening.

6. The sighting device of claim 1 wherein the rear lens is located within the housing and abuts with the lens spacer; and wherein the securing means further comprises, in combination: a second lens holder held in the housing adjacent the rear opening for abutting with the rear lens opposite to the lens spacer.

7. The sighting device of claim 1 wherein the securing means further comprises, in combination: means for adjusting the elevation and windage of the front lens relative to the rear lens comprising, in combination: a base having an extension extending upwardly; means for pivotally mounting the housing relative to the base about a windage axis generally perpendicular to the sighting line; means for biasing the housing to pivot in a first direction about the windage axis; a windage adjustment screw extending from the extension for adjustably pushing the housing in a direction opposite to the first direction; means for pivotally mounting the housing relative to the base about an elevation axis generally perpendicular to the sighting line and to the windage axis; means for biasing the housing to pivot in a second direction about the elevation axis; and means for pushing the housing in a direction opposite to the second direction for adjusting the elevation of the housing.

8. The sighting device of claim 7 wherein securing means includes means for securing the front lens and the rear lens to a firearm.

9. The sighting device of claim 1 wherein the front opening is larger than the rear opening.

10. The sighting device of claim 2 wherein the first and second designs are etched on the front and rear lenses.

11. The sighting device of claim 2 wherein the first and second designs are formed of self-luminous material.

12. The sighting device of claim 11 wherein the self-luminous material does not require exposure to sunlight or artificial light to luminate.

13. The sighting device of claim 1 wherein the securing means comprises, in combination: a block of clear material, with the front and rear lenses being formed integrally with and on opposite sides of the block of clear material.

14. Sighting device comprising, in combination: a front lens; a rear leans; means for securing the front lens and the rear lens in a spaced apart relation comprising, in combination: a block of clear material, with the front and rear lenses being formed integrally with and on opposite sides of the block of clear material; a first design marked on the front lens; and a second design marked on the rear lens, with the first design appearing to be centered on the second design when viewing along a sighting line through the front lens and the rear lens on a level plane, and wherein the first and second designs are marked on the front and rear lenses by filling chambers formed in the block with non-transparent liquid.

15. The sighting device of claim 14 wherein the non-transparent liquid is self-luminous under low light conditions.

16. The sighting device of claim 15 wherein the non-transparent, self-luminous liquid does not require exposure to sunlight or artificial light to luminate.

17. The sighting device of claim 14 wherein the first design is a cross-like marking, and wherein the second design is a circular marking, with the cross-like marking appearing to be centered on the circular marking when viewing through the front lens and the rear lens on a level plane.

18. Apparatus for adjusting the elevation and windages of a sighting device for sighting along a sighting line comprising, in combination: a base having an extension extending upwardly; means for pivotally mounting the sighting device relative to the base about a windage axis generally perpendicular to the sighting line; means for biasing the sighting device to pivot in a first direction about the windage axis; a windage adjustment screw extending from the extension for adjustably pushing the sighting device in a direction opposite to the first direction; means for pivotally mounting the sighting device relative to the base about an elevation axis generally perpendicular to the sighting line and to the windage axis; means for biasing the sighting device to pivot in a second direction about the elevation axis; and means for pushing the sighting device in a direction opposite to the second direction for ad the elevation of the sighting device.

19. The apparatus of claim 18 the first direction biasing means comprises an extension spring connected between the sighting device and the base; wherein the windage adjustment screw is threadably received in the extension; wherein the second direction biasing means comprises a flat spring extending between the base and the sighting device; and wherein the elevation adjusting means comprises an elevation adjustment screw extending between the base and the sighting device.

20. The apparatus of claim 18 wherein the elevation axis pivotally mounting means comprises, in combination: a housing carriage; and means for pivotally mounting the sighting device to the housing carriage about the elevation axis, with the windage axis pivotally mounting means comprising means for pivotally mounting the housing carriage to the base about the windage axis.

* * * * *

UNITED STATES PATENT AND TRADEMARK OFFICE

CERTIFICATE OF CORRECTION

PATENT NO. : 5,025,564

DATED : June 25, 1991

INVENTOR(S) : Ronald J. Sanders

It is certified that error appears in the above-identified patent and that said Letters Patent is hereby corrected as shown below:

On the Title page, item [57],

In the Abstract, line 14, cancel "impace" and substitute therefor --impact--.

Column 1, lines 52-55, delete "FIG. 3 shows..." through and including "... apparatus of FIG. 1."

Column 1, line 56, cancel "5" and substitute therefor --3--.

Column 3, line 16, delete "76 and".

Column 3, line 31, delete "116 and".

Column 3, lines 35-40, delete "Whereas FIGS. 1 and 2 show..." through and including "... electronic lighting means."

Column 3, line 41, delete "in FIG. 3".

Column 3, line 59, cancel "3" and substitute therefor --2--.

Column 4, line 14, cancel "FIGS. 1-4" and substitute therefor --FIG. 1--.

Column 4, line 16, cancel "5" and substitute therefor --3--.

Column 4, line 17, cancel "FIGS. 1, 2, 3 and 4," and substitute therefor --FIG. 1,--.

Column 4, line 19, cancel "FIGS. 1 and 3" and substitute therefor --FIG. 1--.

Claim 8, line 1, after "wherein" insert --the--.

UNITED STATES PATENT AND TRADEMARK OFFICE

CERTIFICATE OF CORRECTION

PATENT NO. : 5,025,564

DATED : June 25, 1991

INVENTOR(S) : Ronald J. Sanders

It is certified that error appears in the above-indentified patent and that said Letters Patent is hereby corrected as shown below:

Column 6, line 46, cancel "ad" and substitute therefor --adjusting--.

Signed and Sealed this

Fifteenth Day of June, 1993

*Attest:*

Michael K. Kirk

MICHAEL K. KIRK

*Attesting Officer*

*Acting Commissioner of Patents and Trademarks*